US007802682B2

(12) United States Patent
Bitner

(10) Patent No.: US 7,802,682 B2
(45) Date of Patent: Sep. 28, 2010

(54) SYSTEMS FOR INCREASING COMPLIANCE WITH A MEDICAMENT TREATMENT REGIME

(75) Inventor: John Bitner, Sugar Grove, IL (US)

(73) Assignee: Watson Laboratories, Inc., Salt Lake City, UT (US)

( * ) Notice: Subject to any disclaimer, the term of this patent is extended or adjusted under 35 U.S.C. 154(b) by 423 days.

(21) Appl. No.: 11/877,481

(22) Filed: Oct. 23, 2007

(65) Prior Publication Data

US 2009/0101536 A1 Apr. 23, 2009

(51) Int. Cl.
*B65D 83/04* (2006.01)
*B65B 1/04* (2006.01)

(52) U.S. Cl. ..... 206/531; 53/467; 53/473; 206/534; 206/459.1

(58) Field of Classification Search ..... 206/459.1, 206/528, 530–532, 534, 534.1, 538, 539, 206/204, 807, 484, 484.1; 53/396, 453, 467, 53/473; 428/35.2, 357.7, 35.8
See application file for complete search history.

(56) References Cited

U.S. PATENT DOCUMENTS

| | | | | |
|---|---|---|---|---|
| 4,374,571 | A | 2/1983 | Hirvela | |
| 4,717,017 | A | 1/1988 | Sprinkel, Jr. et al. | |
| 5,011,019 | A * | 4/1991 | Satoh et al. | 206/530 |
| 5,425,699 | A | 6/1995 | Speigel | |
| 5,518,790 | A * | 5/1996 | Huber et al. | 428/35.2 |
| 5,532,229 | A | 7/1996 | Vieth | |
| 5,589,275 | A * | 12/1996 | Breitler et al. | 206/531 |
| 5,665,817 | A | 9/1997 | Greff | |
| 5,771,778 | A | 6/1998 | MacLean, IV | |
| 5,853,757 | A | 12/1998 | Durand et al. | |
| 5,904,916 | A | 5/1999 | Hirsch | |
| 6,279,736 | B1 * | 8/2001 | Hekal | 206/204 |
| 6,471,063 | B2 * | 10/2002 | Stepp | 206/530 |
| 6,564,934 | B1 | 5/2003 | Dischler | |
| 6,724,298 | B2 | 4/2004 | Smith | |
| 6,854,368 | B2 | 2/2005 | Calwell | |
| 6,899,486 | B2 | 5/2005 | Wetzel et al. | |
| 6,938,832 | B2 | 9/2005 | Sada | |
| 2006/0068003 | A1 * | 3/2006 | Herz | 424/464 |
| 2007/0138049 | A1 | 6/2007 | Bitner | |

* cited by examiner

*Primary Examiner*—Luan K Bui
(74) *Attorney, Agent, or Firm*—Florek & Endres PLLC

(57) ABSTRACT

A container for storing a medicament comprises a deformable shell including at least one blister associated therewith. A unit of medicament is stored in the at least one blister. A rupturable material is coupled over an opening of the blister, the rupturable material being configured to rupture upon dispensing of the unit of medicament from the blister. An aroma discharge system is coupled to, or over the opening of, the blister, the aroma discharge system containing an aroma generating substance. The aroma discharge system is positioned such that dispensing of the unit of medicament from the blister results in discharge of the aroma from the aroma generating substance.

8 Claims, 2 Drawing Sheets

SYSTEMS FOR INCREASING COMPLIANCE WITH A MEDICAMENT TREATMENT REGIME

BACKGROUND OF THE INVENTION

1. Field of the Invention

The present invention relates generally to systems for packaging medicaments in a manner that increases a patient's compliance with a treatment regimen.

2. Related Art

Treatment of many common illnesses dictates the administration of medicaments in a planned and controlled manner. In a typical scenario, a physician prescribes a course of treatment for a patient, and the patient is responsible for taking a prescribed medication according to the instructions of the physician. However, many studies have indicated that patients fail to comply with instructions provided to the patient by the physician.

Reasons for a patient's noncompliance with a treatment regimen have been shown to vary. In some cases, a physician may prescribe multiple medications aimed at treating different aspects of an illness. As the number of medications prescribed increases, the responsibility on the part of the patient increases due to different dosages, intervals between dosages, and the like. This increase in number of medications can cause a patient to forget to take a particular medication, or cause him or her to fail to remember whether or not a particular medication has been taken.

A patient's noncompliance with a prescribed regimen can lead to several problems. First, the desired effect, or the most beneficial effect, of treatment may not be obtained. Second, when missing a dose, a patient may attempt to rectify the situation by taking an additional dose. However, a dose taken at the incorrect time and interval could have severe consequences for some drugs. In addition, irregular drug administration could lead to drug resistance.

Oftentimes, patients rely on their memory and/or on manually operated medication dispensers to manage their treatment and their compliance with the instructions provided by the physician. For example, patients may rely on daily dosage pillboxes, or similar devices, to remind them to take their medication on a daily basis. However, these devices do not generally include any indicators for determining proper dosage intervals, especially for medications that must be taken more than once a day. Moreover, these devices do not provide any mechanism for alerting a patient to the proper time and/or day for taking the prescribed medication.

Several efforts have been made to produce a device or method to help improve patient compliance with treatment regimens. Some recently developed medicament dispensing containers include audible and visual alerts to remind a patient that it is time to take a medicine. However, such devices are overly complex, require relatively sophisticated and cumbersome programming operations, and only operate properly if the medication packaging is maintained within visual or auditory range of the patient.

SUMMARY OF THE INVENTION

The invention provides a container for storing a medicament, including a deformable shell having at least one blister associated therewith. A unit of medicament can be stored in the at least one blister. A rupturable material can be coupled over an opening of the blister. The rupturable material can be configured to rupture upon dispensing of the unit of medicament from the blister. An aroma discharge system can be coupled to the blister, the aroma discharge system containing an aroma generating substance. The aroma discharge system can be positioned such that dispensing of the unit of medicament from the blister results in discharge of the aroma from the aroma generating substance.

In accordance with another aspect of the invention, a device for increasing compliance with a medicament treatment regime is provided, including a container suitable for receiving and storing a plurality of units of medicament therein. A closure can be securable to the container. The closure can be operable to: protect the medicament from exposure to a surrounding environment; and be opened by a user to provide access to the units of medicament. An aroma discharge system can contain an aroma generating substance, the aroma discharge system being configured to discharge an aroma from the aroma generating substance into an adjacent environment upon opening of the closure each time a unit of medicament is dispensed from the container. The units of medicament can be isolated from the aroma generating substance to limit migration of matter from the aroma generating substance to the medicament when the closure is secured to the container.

In accordance with another aspect of the invention, a system for increasing compliance with a medicament treatment regime is provided, including a container suitable for receiving and storing a plurality of units of medicament therein. A closure can be securable to the container. The closure can be operable to: protect the medicament from exposure to a surrounding environment; and be opened by a user to provide access to the units of medicament. An aroma discharge system can contain an aroma generating substance, the aroma discharge system being configured to discharge an aroma from the aroma generating substance into an adjacent environment upon opening of the closure. An extrinsic olfactory stimulus can have a reference aroma associated therewith, the reference aroma corresponding with the aroma discharged from the aroma generating substance upon opening of the closure.

In accordance with another aspect of the invention, a method for improving compliance with a medicament treatment regime is provided, including: providing to a patient an extrinsic olfactory stimulus having a reference aroma associated therewith; configuring a medicament container such that upon opening of the container an aroma is discharged into an adjacent environment, the aroma corresponding to the reference aroma; and training the patient to associate the reference aroma with the aroma discharged upon opening of the container such that the patient is reminded of the medicament upon experiencing the reference aroma.

In accordance with another aspect of the invention, a method of reminding a patient to timely utilize a medicament is provided, including: training the patient to associate a reference aroma with the medicament; and exposing the patient to the reference aroma at an appropriate time of day to thereby remind the patient to utilize the medicament.

There has thus been outlined, rather broadly, relatively important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1:
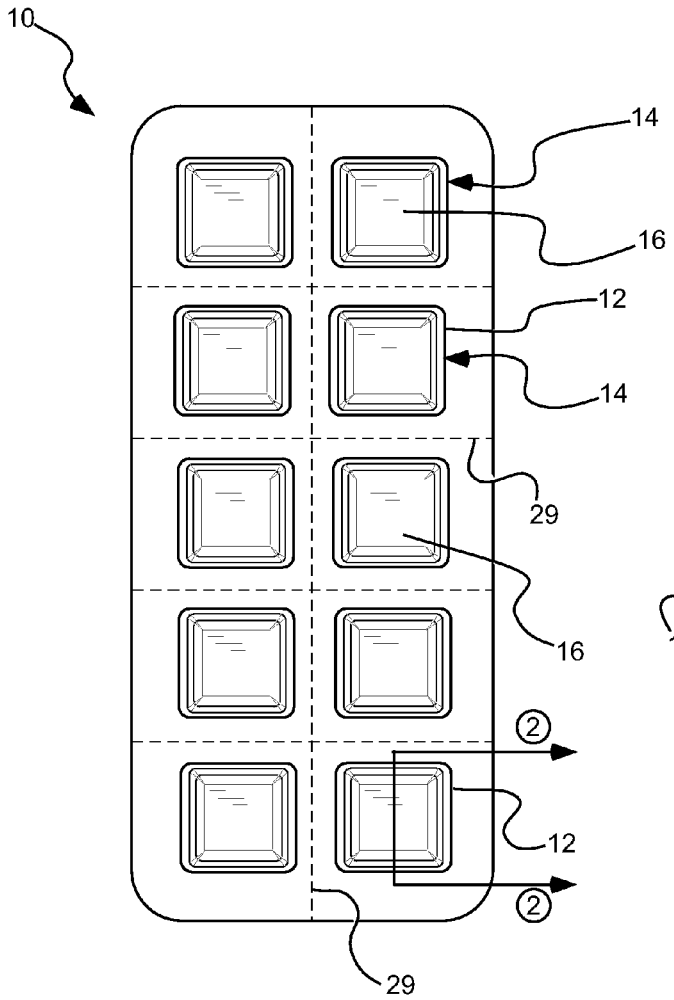
FIG. 1 is a top view of an exemplary medicament container in accordance with an embodiment of the invention.

It is to be understood that the attached figures are provided to aid in describing the present invention in a manner the most descriptive manner. While the figures generally illustrate important features of the invention, some of the features shown in the figures may not be drawn to scale and may not be accurately scaled relative to other features shown in the figures. Also, it may be the case that adherence to standard drawing conventions has been sacrificed in the interest of most clearly presenting the inventive features of the invention.

DETAILED DESCRIPTION

Before the present invention is disclosed and described, it should be understood that this invention is not limited to the particular structures, process steps, or materials disclosed herein, but is extended to equivalents thereof as would be recognized by those of ordinarily skill in the relevant arts. It should also be understood that terminology employed herein is used for the purpose of describing particular embodiments only and is not intended to be limiting in any way.

It must be noted that, as used in this specification and the appended claims, the singular forms "a" and "the" include plural referents, unless the context clearly dictates otherwise. Thus, for example, reference to an "aroma discharge system" can, but does not necessarily, include one or more of such systems.

DEFINITIONS

In describing and claiming the present invention, the following terminology will be used in accordance with the definitions set forth below.

As used herein, the term "blister pack" is to be understood to refer to a package of medicament (or similar product), in which discrete quantities or units of the medicament are stored in a "blister" and dispensed by applying force to the blister to expel or dispense the medicament from the blister pack. It is contemplated that the present invention can be utilized with commonly available blister packaging technology, and can be adapted for use with known blister pack configurations in addition to use with blister packs specifically designed to be incorporated into the present configuration.

As used herein, the term "medicament" is to be understood to refer to a variety of medications, drug, pharmaceutics, dietary supplements, etc. As applied to the present invention, medicaments can be available to users or patients as over-the-counter therapy or by prescription only, and can be in the form of tablets, capsules, powders, liquids, creams, granules, etc., as would be readily understood by those having ordinary skill in such fields of endeavor.

As used herein, the term "aroma generating substance" is to be understood to refer to a substance or material that is capable of releasing one or more agents that, alone or combined, cause a nearby human subject to experience the sensation of smell. Aroma generating substances can include substances that substantially continuously generate an aroma, and substances that only generate an aroma when exposed to specific environmental conditions. For example, some aroma generating substances will not produce an aroma until exposed to oxygen. Others will not generate a level of aroma discharge sufficient to trigger the sense of smell in a human subject unless an ambient temperature is above a minimum threshold level.

Generally, when an "aroma" is discussed herein, it is understood that the aroma will be identifiable by a human subject as corresponding to some material or substance existing in the physical world. Examples of suitable aromas include, without limitation, various fruits (e.g., bananas, oranges, etc.), floral scents, food scents, coffee, aftershave scents, cologne, perfumed, etc. While it may be the case that a typical polymer medicament packaging includes an "aroma," as that broad term is sometimes used, the systems described herein typically produce aromas identifiable by human subjects as corresponding to some item or substance other than materials typically used in packaging systems. Generally speaking, the aroma or aromas produced by the present systems will not correspond to (e.g., will be different from) an aroma (if any) exhibited by the corresponding medicament.

As used herein, the term "substantially" refers to the complete or nearly complete extent or degree of an action, characteristic, property, state, structure, item, or result. For example, when a medicament is discussed herein as being "substantially isolated" from an aroma generating substance, it is understood that the medicament is either completely isolated from the aroma generating substance, or so nearly completely isolated that a typical person would be unable to appreciate the difference. The exact allowable degree of deviation from absolute completeness may in some cases depend upon the specific context. However, generally speaking, the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. For example, when a substance is discussed herein as being "substantially devoid" of aroma generating constituents, the substance would either completely lack any aroma generating constituents, or so nearly completely lack such constituents that the effect would be the same as if it completely lacked the constituents. In other words, a material that is "substantially devoid of" aroma generating constituents may still actually contain one or more such constituents so long as there is no discernable aroma generated by such material.

As used herein, the term "about" is used to provide flexibility to a numerical range endpoint by providing that a given value may be "a little above" or "a little below" the endpoint.

Distances, angles, forces, weights, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 inch to about 5 inches" should be interpreted to include not only the recited values of about 1 inch to about 5 inches, but also include individual values and sub-ranges within the indicated range. This same principle applies to ranges reciting only one numerical value and should apply regardless of the breadth of the range or the characteristics being described.

THE INVENTION

The present invention is directed generally to systems and methods for use in increasing patient compliance with medicament regimes. The present invention utilizes a patient's sense of smell to remind (or otherwise compel) the patient to administer a particular medicament. In accordance with one exemplary embodiment, a method of improving a patient's compliance with a medicament treatment regime is provided, including providing to the patient an extrinsic olfactory stimulus having a reference aroma associated therewith. This can include, without limitation, providing a naturally occurring, or artificially produced, aroma that will generally be easily recognized by the patient. Non-limiting examples of such aromas include aromas produced by substances such as coffee, fruits (e.g., oranges, bananas, strawberries, etc.), flowers, plants, aftershave, cologne or perfume scents, etc.

A medicament container can be configured such that, upon opening of the container, an aroma is discharged into an adjacent environment, the aroma corresponding to the reference aroma. For example, in the case that the reference aroma comprises a coffee aroma, opening of the container will result in the discharge of a coffee scent into an environment adjacent to the container (the area generally occupied by the patient opening the container). The patient can be trained to associate the reference aroma with the aroma discharged upon opening of the container so that the patient is reminded of the medicament upon experiencing the reference aroma.

Thus, in the example provided above, the patient can be trained, through various techniques, to associate the smell of coffee with a particular medicament. In one example, such a medicament could be prescribed as part of a treatment regime calling for the medicament to be administered each morning. When the patient arises each morning, he or she may encounter the aroma of coffee. The patient, having been trained to associate the smell of coffee with this particular medicament, can then be reminded, or otherwise compelled, to take the medicament prescribed to him or her.

The aroma selected for association with the particular medicament can be tailored to specific patients, based on a lifestyle or habitual patterns of that particular patient. The example provided above may be well suited for a patient who regularly drinks coffee in the morning. Other patients, who may forego the morning cup of coffee, may be better served by utilizing a different scent, perhaps one associated with a regular part of his or her lifestyle. For example, such a patient may regularly apply aftershave or perfume each morning. In such a case, he or she could be trained with an aroma that simulates the aroma of the aftershave or perfume to increase his or her compliance with a medicament regime.

In addition to reference scents or aromas that a person may encounter in daily life, the present invention can include specifically configured extrinsic olfactory stimuli that generate the reference aroma in a controlled, predictable manner. For example, scent dispersion systems are available that can be programmed to disperse a scent or aroma into an environment at selected intervals. In one embodiment of the invention, a scent dispersion system can be installed in a patient's home and can be programmed (or otherwise configured) to emit into the home environment a reference aroma at one or more particular times during the day. For example, the scent dispersion system could emit the reference aroma into the home environment at about 10:00 PM each night. Upon experiencing the reference aroma, the patient could be reminded or compelled to administer a medicament prescribed to be administered each night before retiring to bed. A similar scheme can be employed throughout various times of the day, and could be utilized not only in a patient's home, but in his or her vehicle, place of employment, etc.

The patient could be trained to associate the reference aroma with a particular medicament in a variety of manners that will be appreciated by those of ordinary skill in the art having possession of the present disclosure. In one non-limiting, exemplary embodiment, the patient can be instructed, for an initial period of time, to generate an aroma each time he or she administers a particular medicament. For example, he or she can be instructed to activate a well-known "scratch and sniff" sample each time he or she administers a medicament for the first two weeks of the treatment regime. After this initial training period, the patient can have learned to associate the reference aroma generated by the "scratch and sniff" sample with the medicament. Each time the patient thereafter experiences the reference aroma, he or she will be reminded of the medicament. In this manner, the patient's compliance with the treatment regime involving the medicament can be significantly increased.

Figure 2:
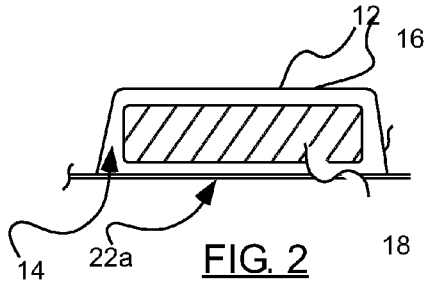
FIG. 2 is a sectioned view of a blister portion of the medicament container of FIG. 1, taken along section 2-2 of FIG. 1.
Figure 3:
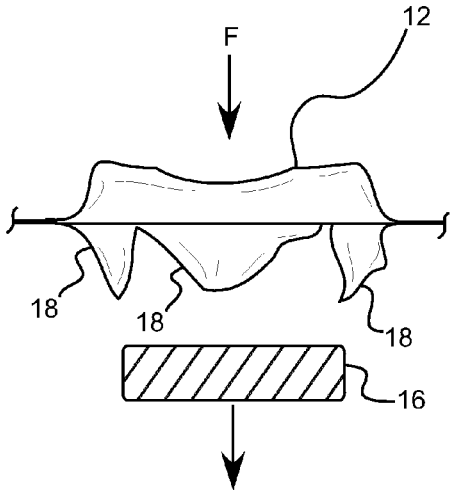
FIG. 3 is partially sectioned view of the blister portion of FIG. 1, shown after a unit of medicament has been dispensed therefrom.

The manner in which the patient can be trained to associate the reference aroma with the medicament can vary. In one embodiment, a specialized container can be utilized that generates a reference aroma each time the medicament is dispensed, thereby aiding in training (and/or reinforcing) the patient's association of the medicament with the reference aroma. One exemplary such container is illustrated in FIGS. 1-3. In this aspect of the invention, the container 10 includes a deformable shell 12 including at least one pocket or blister 14 associated therewith. A unit of medicament 16 can be stored in the at least one blister.

As more clearly illustrated in FIGS. 2 and 3, a rupturable material 18 can be coupled over an opening of the blister 14. The rupturable material can be configured to rupture upon dispensing of the unit of medicament 16 from the blister. An aroma discharge system (shown schematically at 22*a* in FIG. 4) can be coupled to the blister and can contain an aroma generating substance. The aroma discharge system can be positioned such that dispensing of the unit of medicament from the blister results in discharge of the aroma from the aroma generating substance. As shown in FIG. 3, the unit of medicament can be dispensed from the blister by the application of force F to a top portion of the blister. As force is applied to the blister, the blister collapses inward, and the unit of medicament is forced into the rupturable material. The rupturable material is ruptured as a result, and the unit of medicament is free to be withdrawn from the blister.

In the embodiment of FIG. 3 (shown in more detail in FIG. 4), the aroma discharge system is a thin layer of material coupled immediately adjacent the rupturable material 18. Breakage of the rupturable material correspondingly results in the aroma generating substance releasing the aroma into the adjacent environment, where the aroma is experienced by the patient opening the container.

The blister pack container 10 can be formed in a variety of manners known to those having ordinary skill in the art and can be formed from a variety of suitable materials. In general, the blister pack can include a shell material that is formed to include a series of indentations or pockets (e.g., individual "blisters") 14 that are each configured to receive one or more units of medicament 16. The shell material can be, but is not necessarily, formed of a plastic material such as a polyvinyl chloride laminate. A generally thin metal foil, or other rupturable material, 18 can be attached or adhered to the shell material around and across openings in the depressions or indentations (e.g., "blisters").

Structures similar to the blister pack container 10 illustrated in FIG. 1 have been used for a number of years in a variety of applications. While not so required, a series of perforations 29 can be formed in the blister pack container 10 to allow each blister to be individually separated into a discrete unit. A substantially continuous sheet of rupturable material can be applied over the entire undersurface of the blister pack, and each blister can be separated from the remainder of blisters with the portion of the rupturable material covering the particular blister remaining intact and uncompromised.

Figure 4:
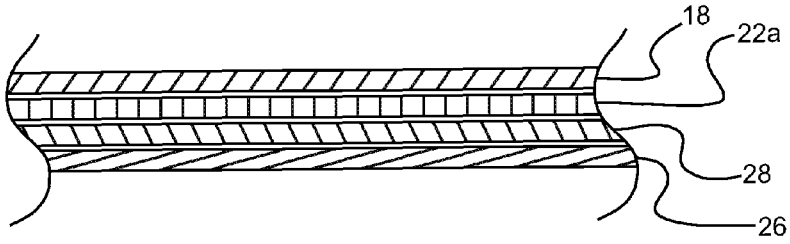
FIG. 4 is a more detailed, sectioned view of a material layer portion of the blister of FIG. 2.

FIG. 4 schematically illustrates a more detailed, sectional view of an exemplary configuration of covering material that can be utilized to cover the openings of the blisters 14. In the embodiment shown, a lowermost layer (e.g., a layer furthest removed from the unit of medicament) can include a backing layer 26 that can be configured to protect the rupturable layer from rupturing prior to removal of the backing layer. Immediately adjacent the backing layer can be a sealant layer 28 configured to isolate the aroma discharge system 22*a* (and/or the aroma generating substance) from the medicament 16 and from exposure to an adjacent environment prior to dispensing of the medicament from the blister. The uppermost layer of the covering material can comprise the rupturable material 18 described above.

Thus, in the embodiment shown, the backing layer 26 can be removed from the underportion of the blister, with the aroma generating substance remaining intact. Upon dispensing of the unit of medicament from the blister, the rupturable material, the sealant layer and the aroma generating substance can all be ruptured, broken, split, or otherwise comprised, to simultaneously allow the unit of medicament to be withdrawn from the blister and to release the aroma into an adjacent environment. In this embodiment, the aroma is not released until the unit of medicament is forced through the rupturable material (or until the rupturable material is otherwise comprised).

In other embodiments, the locations of (and/or the existence of) the rupturable material 18, the sealant layer 28 and the aroma discharge system 22*a* can be varied. For example, the aroma generating substance of the aroma discharge system can be disposed immediately adjacent the backing layer such that, as the patient begins dispensing of the unit of medicament from the blister (which necessarily begins by removal of the backing layer), the aroma is released. In other words, removal of the backing material releases the aroma into the adjacent environment, just prior to removal of the unit of medicament from the blister. This embodiment can be utilized in blister packaging systems that include a rupturable material; and in blister packaging systems that do not include a rupturable material, wherein access to the medicament is gained by simply removing the backing material from the blister.

Regardless of the specific relationship of the various layers discussed, in most embodiments the medicament will be substantially isolated from the aroma generating substance until dispensing of the medicament, after which very minor contact between the medicament and the aroma generating substance may occur. It is generally the case, however, that such contact will be limited. This aspect of the invention can be advantageous in that the formulation of many medicaments is very carefully controlled, and it may not be permissible to expose the medicament to the aroma generating substance for significant periods of time. Prolonged exposure of the medicament to the aroma generating substance may adversely affect the taste of the medicament, the efficacy of the medicament, etc. The present invention advantageously allows nearly simultaneous dispensing of the medicament and release of the aroma into the adjacent environment, safely isolating the medicament from the aroma generating substance prior to dispensation.

Figure 5:
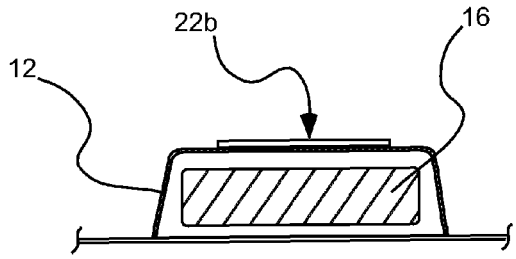
FIG. 5 is a sectioned view of another blister portion of a container in accordance with an embodiment of the invention.

FIG. 5 illustrates an embodiment of the invention that further removes the medicament 16 from aroma discharge system 22*b*. In this aspect of the invention, the aroma discharge system is coupled to an outer portion of the blister 12. As the blister is deformed during dispensation of the medicament, the aroma discharge system releases the aroma into the adjacent environment, without undue risk of exposing the medicament to contact with the aroma generating substance.

Figure 6:
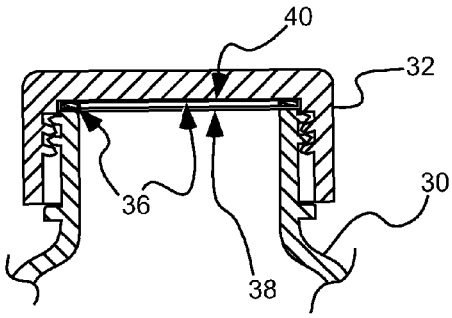
FIG. 6 is a sectioned view of another medicament container in accordance with an embodiment of the invention.

FIG. 6 illustrates another embodiment of the invention, in which a container 30 is provided that can be suitable for receiving and storing a plurality of units of medicament (not shown) therein. The container can include a closure (e.g., threadably attached lid or cap) 32 that can be removably securable to the container. The closure can be operable to both protect the medicament from exposure to a surrounding environment, and be opened by a user to provide access to the units of medicament. In this aspect of the invention, the aroma discharge system can include an annular strip 36 of an aroma generating substance attached either to the closure 32 or to the container 30. As the lid is secured to the bottle, the strip of aroma generating substance can be pressed between two substantially solid surfaces (e.g., surface 40 of the lid or cap and surface 38 of the bottle) such that generation of the aroma is stifled or de-activated.

This aspect of the invention is well suited for the storage of, and individual dispensation of, a plurality of medicament capsules or tablets. The container can be re-closed after one or more tablets are dispensed, and the aroma generating substance can be deactivated or stifled to limit or prevent further generation of aroma. In this manner, each time a tablet or capsule is dispensed, the aroma is generated. However, upon closure of the lid or cap 32, the capsules or tablets remaining in the bottle are protected from exposure to additional aroma generation.

In one aspect of the invention (not shown in the figures), the aroma discharge system (and/or the aroma generating substance) can be associated with a peelable label or similar structure of the container. For example, it is often the case that medicament information, dosage instructions, warnings, etc., are provided on a medicament container within a "fold-out" panel enclosure that is reusably adhered to the container. A patient can unfold this enclosure and expose one or more panels of printed information relating to the medicament provided in the container (oftentimes, two or three panels of information are provided in a layered configuration). The present invention can be incorporated into the reusable adhesive of this panel enclosure such that the aroma is released into the atmosphere each time the panels are unfolded.

Thus, in some embodiments of the invention, the aroma generating substance is not associated with the mechanism of the container that allows dispensing of the medicament from the container, but rather can be attached to the container as a distinct, stand-alone system.

The aroma discharge systems and/or aroma generating substances discussed herein can generate aroma in a variety of manners known to those of skill in the relevant art. For example, aroma can be generated as heat is applied to the aroma generating substance. Various chemical reactions can directly cause release of the aroma, or can generate heat which results in the release of the aroma. In some embodiments, exposure of the aroma generating substance to the atmosphere (e.g., to moisture, oxygen or nitrogen in the atmosphere) can result in the release of the aroma.

Also, various frictional or destructive forces can result in the release of the aroma. For example, technology commonly referred to as "scratch and sniff" utilizes microencapsulation technology to limit or prevent the release of aroma until an aroma-generating chemical is released from encapsulation in (generally very small) gelatin or plastic spheres. When the spheres are ruptured, the aroma is released into the adjacent environment. A variety of other aroma releasing technologies can be readily incorporated into the present invention. In one aspect of the invention, the aroma generating substance can be combined with an adhesive layer use to attach two or more material layers to one another. As the two or more material layers are forcibly separated, the adhesive layer is partially exposed, or partially destroyed, resulting in release of the aroma.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A container for storing a medicament, comprising:

a deformable shell including at least one blister associated therewith;

a unit of medicament, stored in the at least one blister;

a rupturable material coupled over an opening of the blister, the rupturable material being configured to rupture upon dispensing of the unit of medicament from the blister;

a sealant layer disposed between the medicament in the blister and the rupturable material;

an aroma discharge system coupled between the sealant layer and the rupturable material, the aroma discharge system containing an aroma generating substance that is substantially isolated from the medicament prior to dispensing of the medicament; and the aroma discharge system being positioned such that dispensing of the unit of medicament from the blister results in discharge of the aroma from the aroma generating substance.

2. The container of claim 1, further comprising a backing layer, disposed on an opposite side of the rupturable material from the blister, the backing layer being configured to protect the rupturable material from rupturing prior to removal of the backing layer.

3. The container of claim 1, further comprising a plurality of blisters, each having a unit of medicament stored therein.

4. The container of claim 3, further comprising a substantially continuous sheet of rupturable material coupled over an opening of each of the plurality of blisters.

5. The container of claim 3, wherein one of the blisters can be separated from adjacent blisters while maintaining the rupturable material over the opening of the one blister in an un-ruptured condition.

6. The container of claim 1, wherein the aroma from the aroma generating substance is different than an aroma of the medicament.

7. A method for improving compliance with a medicament treatment regime, comprising:

providing to a patient an extrinsic olfactory stimulus having a reference aroma associated therewith;

configuring a medicament container such that upon opening of the container an aroma is discharged into an adjacent environment, the aroma corresponding to the reference aroma; and training the patient to associate the reference aroma with the aroma discharged upon opening of the container such that the patient is reminded of the medicament upon experiencing the reference aroma;

wherein the medicament container comprises:

a deformable shell including at least one blister associated therewith;

a unit of medicament, stored in the at least one blister;

a rupturable material coupled over an opening of the blister, the rupturable material being configured to rupture upon dispensing of the unit of medicament from the blister;

a sealant layer disposed between the medicament in the blister and the rupturable material;

an aroma discharge system coupled between the sealant layer and the rupturable layer, the aroma discharge system containing an aroma generating substance that is substantially isolated from the medicament prior to dispensing of the medicament; and the aroma discharge system being positioned such that dispensing of the unit of medicament from the blister results in discharge of the aroma from the aroma generating substance.

8. A method of reminding a patient to timely utilize a medicament, comprising:

training the patient to associate a reference aroma with the medicament; and exposing the patient to the reference aroma at an appropriate time of day to thereby remind the patient to utilize the medicament;

wherein the medicament is contained within a medicament container comprising:

a deformable shell including at least one blister associated therewith;

a unit of medicament, stored in the at least one blister;

a rupturable material coupled over an opening of the blister, the rupturable material being configured to rupture upon dispensing of the unit of medicament from the blister;

a sealant layer disposed between the medicament in the blister and the rupturable material;

an aroma discharge system coupled between the sealant layer and the rupturable layer, the aroma discharge system containing an aroma generating substance that is substantially isolated from the medicament prior to dispensing of the medicament; and the aroma discharge system being positioned such that dispensing of the unit of medicament from the blister results in discharge of the aroma from the aroma generating substance.

* * * * *